US006679186B2

(12) United States Patent
Prevost

(10) Patent No.: US 6,679,186 B2
(45) Date of Patent: Jan. 20, 2004

(54) MOTORIZED DOOR-LOCKING DEVICE OF REDUCED SIZE

(75) Inventor: Jany Prevost, Joue les Tours (FR)

(73) Assignee: Faiveley Transport, Saint Denis (FR)

( * ) Notice: Subject to any disclaimer, the term of this patent is extended or adjusted under 35 U.S.C. 154(b) by 0 days.

(21) Appl. No.: 10/097,438

(22) Filed: Mar. 14, 2002

(65) Prior Publication Data

US 2002/0144625 A1 Oct. 10, 2002

(30) Foreign Application Priority Data

Mar. 19, 2001 (FR) ..... 01 03689

(51) Int. Cl.[7] ..... B61D 19/00

(52) U.S. Cl. ..... 105/339; 105/333; 105/343; 49/280; 49/281; 49/300; 49/362

(58) Field of Search ..... 105/331, 332, 105/333, 339, 343; 49/118, 119, 120, 279, 280, 281, 282, 284, 285, 292, 300, 362, 366, 370

(56) References Cited

U.S. PATENT DOCUMENTS 3,745,705 A * 7/1973 Reddy ..... 49/139
4,198,786 A * 4/1980 Monot ..... 49/362
4,901,474 A * 2/1990 Bayard et al. ..... 49/26
5,015,022 A * 5/1991 McGuire ..... 292/278
5,341,598 A 8/1994 Reddy
5,450,651 A * 9/1995 Coleman et al. ..... 16/82
5,927,015 A * 7/1999 Ghosn et al. ..... 49/291
6,009,668 A * 1/2000 Reddy ..... 49/280
6,032,416 A * 3/2000 Springer et al. ..... 49/119
6,220,396 B1 * 4/2001 Heath, III ..... 187/335

FOREIGN PATENT DOCUMENTS

FR 2 768 683 3/1999
GB 2 309 261 A 7/1997

OTHER PUBLICATIONS

French Search Report, 3 pages Nov. 2001, No. 2768683.
English Translation of French Patent No. 2,768,683 (no date).

* cited by examiner

*Primary Examiner*—Mark T. Le
(74) *Attorney, Agent, or Firm*—Harness, Dickey & Pierce, P.L.C.

(57) ABSTRACT

The invention relates to a motorized locking device for a door intended in particular for a rail vehicle, with at least one leaf. The device includes a tilting-body motor intended to be mounted on the vehicle. The axis of the motor is substantially parallel to the longitudinal direction of movement of the leaf.

11 Claims, 2 Drawing Sheets

MOTORIZED DOOR-LOCKING DEVICE OF REDUCED SIZE

BACKGROUND AND SUMMARY OF THE INVENTION

The invention relates to a motorised door locking device intended in particular for a rail vehicle, with at least one leaf, the latter being able to close off and leave clear an opening respectively in the closed and open position.

A motorised door locking device is known in the patent FR 2 768 683 in the name of the applicant. This device comprises:

a tilting-body motor, intended to be mounted on the vehicle, the axis of the said motor being substantially parallel to the longitudinal direction of movement of the said leaf, an output of the said motor being connected to means for the longitudinal transmission of movement to the leaf, the body of the said motor being arranged to be driven in conjoint rotation by the output or immobilised in rotation with respect to the latter, means of locking the leaf in the closed position comprising a locking finger and a substantially longitudinal ramp, the said finger and the ramp being fixed respectively to the tilting body and to the leaf.

In this device, the locking finger is situated substantially at the end of a radial extension of the said tilting body. Such a device does however have drawbacks. In particular, the radial position of the locking finger with respect to the motor requires the whole of the device to be very bulky in terms of overall length. This is because the longitudinal guidance means for the leaf or leaves are, in their extreme positions, situated at a certain distance beyond the door upright. It is therefore necessary to provide, in the door frame, the space necessary for the guidance means in their extreme position, in particular when the door is open.

The aim of the invention is to remedy these drawbacks by producing a locking device considerably reducing the bulk of the said device in terms of overall length. To this end, the locking device comprises at least one locking finger. The body of the motor of the device according to the invention has at its end directed towards the leaf in the closed position a fixed arm extending in a direction substantially parallel to the axis of the motor on the side of the said leaf in the closed position, at least one locking finger being fixed to the free end of the said arm, so that the said locking finger is fixed at a distance from the end of the motor body. The fact that the finger is disposed at a distance from the end of the motor makes it possible to reduce the overall length of the device.

In a variant, the locking means also comprise a second locking finger fixed to the end of the motor body directed towards the leaf in the closed position and extending radially. The presence of a second locking finger makes it possible in particular to reduce still further the length of the ramp and therefore the overall length of the device.

BRIEF DESCRIPTION OF THE DRAWINGS

Other objects and advantages will emerge during the following description, with reference to the accompanying drawings, given by way of non-limitative examples, in which.

DETAILED DESCRIPTION

A motorised door locking device is known in the patent FR 2 768 683 in the name of the applicant. This device is depicted in FIGS. 1 and 2.

Figure 1:
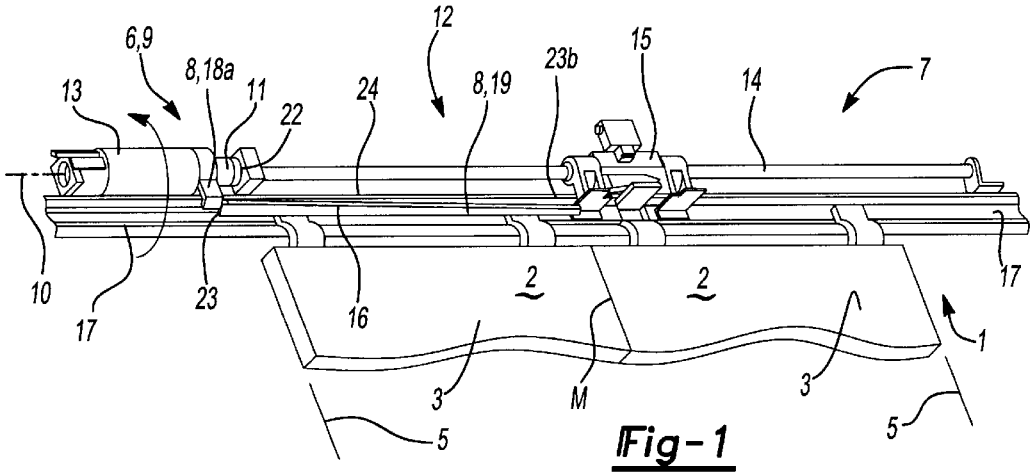
Fig-1 PRIOR ART
FIG. 1 depicts the device as described in the patent FR 2 768 683 in the name of the applicant.
Figures 2, 3A, 4A:
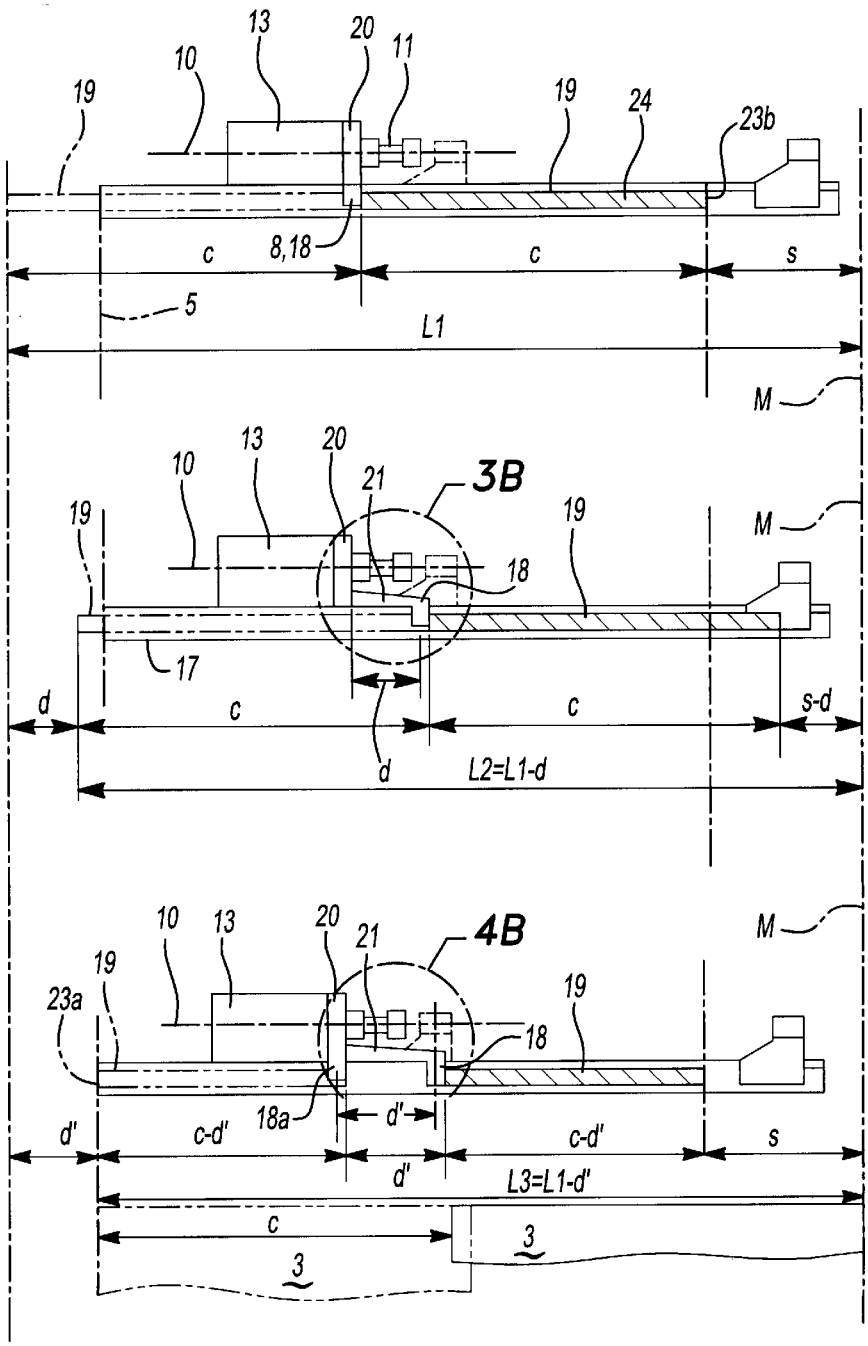
Fig-2 PRIOR ART
FIG. 2 depicts schematically the device of FIG. 1, a single leaf being shown.
FIG. 3A depicts schematically the device according to a first embodiment of the invention, the locking device comprising only one finger and only one leaf being depicted.
FIG. 4A depicts schematically the device according to a second embodiment of the invention, the locking device comprising two fingers and only one leaf being depicted.

With reference to FIG. 1, the wall or partition 1 of a vehicle is equipped with a door 2 with two leaves 3. In the figure, the leaves are in the closed position and close off an opening or void 4 delimited by two substantially vertical uprights 5. The invention also applies to a door 2 with a single leaf 3. A substantially horizontal longitudinal direction L is defined, corresponding substantially to the direction of movement of the leaves 3. The door 2 is provided with motorisation means 6 for driving the leaves 3 substantially in the horizontal direction L.

The embodiment depicted in FIG. 1 corresponds to a door 2 whose path is purely a rectilinear translation. The device can however apply to a door 2 with a swinging and sliding path in other embodiments not shown here but described in the patent FR 2 768 683 in the name of the applicant, to which reference is made.

A motorised locking device 7 is provided on the door 2. It comprises:

the said motorisation means 6;

means 8 of locking the leaf 3 in the open and closed position.

The said motorisation means 6 comprise a motor 9 with a tilting body. The axis 10 of the said motor 9 is substantially parallel to the longitudinal direction L. An output 11 of the said motor is connected to means 12 for the longitudinal transmission of movement to the leaf. The tilting body 13 of the said motor is arranged to be driven in conjoint rotation by the output 11 or immobilised in rotation with respect to the latter. The said longitudinal transmission means 12 comprise a worm 14 fixed to the output 11 of the said motor and extended parallel to the longitudinal direction L.

A nut 15 is engaged on the worm 14 and fixed to a movable runner 16 on a fixed rail 17. The said runner 16 itself being fixed to the leaf 3. The runner 16 and the rail 17 form part of the longitudinal guidance means for the leaves 3.

In the patent FR 2 768 683 of the applicant, the said means 8 of locking the leaf 3 in the closed or open position comprise a finger 18 for locking in position and a substantially longitudinal ramp 19, the said finger 18 and the said ramp 19 being integral respectively with the tilting body 13 and the leaf 3. This locking finger is fixed to the end of the motor body.

Two embodiments of the device according to the invention are now described with reference to FIGS. 3A and B and 4A and B. According to the invention, the said locking means 8 comprise at least one locking finger 18 and a ramp 19. In the figures, the locking finger or fingers 18 and the ramp 19 are respectively fixed to the tilting body 13 and to the leaf 3. However, a converse fixing of these members can be provided for.

The tilting body 13 of the motor has, at its end 20 directed towards the leaf in the closed position, a fixed arm 21. The said fixed arm 21 extends in a direction substantially parallel to the axis 10 of the motor on the same side as the said leaf in the closed position. At least one locking finger 18 is fixed to the free end of the said arm 21, so that the said locking finger is fixed at a distance from the end 20 of the tilting body 13, with reference to FIGS. 3A and B. The said locking finger 18 is for example situated radially with respect to the free end of the fixed arm 21.

In the embodiment depicted in FIGS. 4A and B, the locking means 8 also comprise a second locking finger 18*a* fixed to the end 20 of the body 13 of the motor directed towards the leaf in the closed position. This second finger extends radially with respect to the said end 20. In the two embodiments depicted, each locking finger 18, 18*a* has a running roller 22 mounted so as to pivot with respect to a longitudinal direction.

The ramp 19 is provided with at least one end surface 23*a* substantially perpendicular to the axis 10 of the said motor and a longitudinal track 24 joining the said end surface, so that, in the closed position, the finger 18 is in abutment longitudinally against the said end surface 23*a*. In the open position, the said finger 18 is positioned on the track 24.

In the embodiment with two locking fingers 18, 18*a*, these two fingers are situated substantially at the same distance from the axis 10 of the motor 9 in the same plane, so that one or other of the fingers can follow the longitudinal track 24. In the embodiment depicted in FIGS. 4A and B, the role of the finger 18*a* is to remain on the track 24 of the ramp 19 in order not to lock the door in the open position when the motor is cut off. It is thus possible to close the door manually. In the closed position the finger 18 is then in longitudinal abutment against the end surface 23*a*, the finger 18*a* remaining on the track 24.

In the two embodiments, the tilting of the body 13 of the motor is determined in order to ensure:

- disengagement from the end surface 23*a* against which the finger 18 is brought in abutment, towards a longitudinal track 24 on the ramp 19, or
- engagement with the end surface 23*a* against which the finger 18 must be brought in abutment from the said longitudinal track 24;
- contact on the longitudinal track 24 of the locking finger 18*a* fixed to the end 20 of the body 13 of the motor.

The different motor types 9 which can be used, the functioning of the said motor 9, the transverse guidance means for the leaf or leaves and the functioning of the device are identical to those described in the patent FR 2 768 683 of the applicant, to which reference should be made. They will not be repeated in the present description.

In FIG. 2 corresponding to the device according to the patent FR 2 768 683 in the name of the applicant:

- s designates the distance between the end 23*b* of the ramp 19 directed towards the middle M of the opening and the middle M of the opening, the leaf 3 being closed;
- c designates the travel of the leaf 3.

The length of the ramp 19 is then equal to c, whilst the overall length of the complete mechanism L is $L=L1=2c+s$.

In the embodiment depicted in FIGS. 3A and B, the locking means 8 comprise a single locking finger 18 situated at the end of the fixed arm 21 of the motor. When the leaf 3 is in the closed position, the locking finger 18 comes into abutment against the end surface 23*a* of the ramp 19 on the side of the leaf directed towards the closest upright 5 of the door. Because of the off-centre position of the locking finger 18 with respect to the end 20 of the motor, if d designates the distance between the end 20 of the motor and the locking finger 18, then the overall length of the mechanism is $L=L2=L1-d$, the length of the ramp 19 always being equal to the travel c of the leaf, as defined in FIG. 2. Thus, when the leaf is in the open position, the size of the ramp 19 beyond the upright 5 of the door in the partition of the vehicle is less than the size of the ramp described in the patent FR 2 768 683. This can be seen by comparing FIGS. 2 and 3A.

In the closed position, the size of the ramp 19 on the same side as the opening is on the other hand greater, the end 23*b* of the ramp being situated at a distance s–d from the middle M of the opening, without the ramp projecting beyond the middle M of the opening. For this purpose, the distance d must therefore be less than the distance s.

If reference is now made to FIGS. 4A and B, for which the device comprises two locking fingers 18 at the end of the fixed arm 21 of the motor and 18*a* situated radially at the end 20 of the motor. The distance between the axes of the two locking fingers 18, 18*a* is defined as d'. In this embodiment, the length of the ramp is reduced and equal to c–d' by virtue of the presence of the finger 18*a*. It is then necessary for the distance d' to be less than half the travel c of the leaf in order to prevent the locking fingers 18, 18*a* falling on each side of the ramp 19 and locking the latter whilst the door is not completely closed or open. The overall length of the mechanism is then $L=L3=L1-d'$.

Figure 3B:
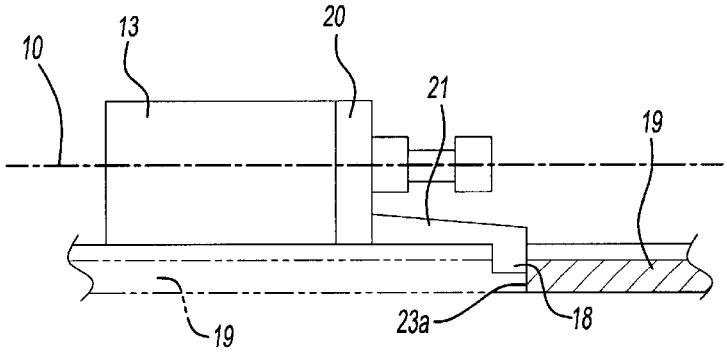
FIG. 3B depicts schematically an enlarged fragmented portion of the device of FIG. 3A within circle 3B.
Figure 4B:
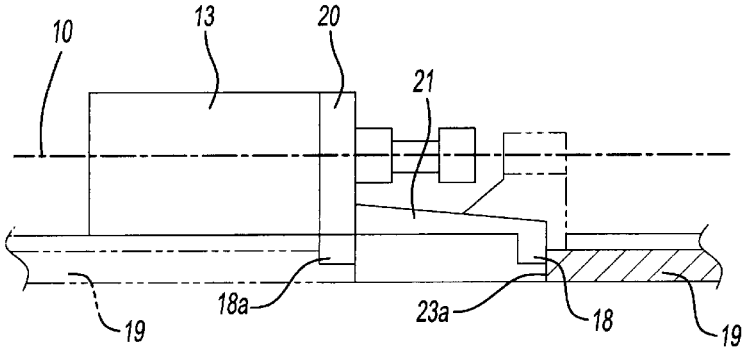
FIG. 4B depicts schematically an enlarged fragmented portion of the device of FIG. 4A within circle 4B.

When the leaf 3 is in the closed position, the locking finger 18 comes into abutment against the end surface 23*a* of the ramp 19 on the side of the leaf directed towards the upright 5 of the door, so that the size of the ramp 19 is identical to that of the device described in the patent FR 2 678 683 (FIG. 2). In the open position, the other locking finger 18*a* rests on the track 24 of the ramp 19, so that the size of the runner is identical to the size of the device depicted in FIG. 3.

In FIGS. 2 to 4B, the size of the ramp 19 when the leaf is in the closed position is indicated in hatching, the size of the ramp 19 when the leaf is in the open position being indicated in dotted lines. In FIG. 4A, the leaf 3 in the closed position is depicted in solid lines, and in dotted lines in the open position. The reduction of the length of the ramp 19 thus makes it possible to considerably reduce the bulk of the mechanism. Thus, in the embodiment in FIGS. 4A and B, the said distance d' is greater than the distance d in the embodiment in FIGS. 3A and B.

For example, in the case of a device according to the invention with one locking finger 18, the overall size L1 of the device described in the patent FR 2 768 683 can be shortened by a distance d=114 mm. The overall size of the mechanism is then $L2=L1-114$ (FIG. 3A, with $d<s$). In the case of a device according to the invention with two locking fingers (FIGS. 4A and B), for a distance d' of around 210 mm, the overall size of the device described in the patent FR 2 768 683 is shortened by the distance d'. The overall size of the mechanism is then $L3=L1-210$ (FIG. 4A with $d<c/2$).

Naturally, these dimensions are given as an indication, and other distances adapted to other doors and/or vehicles can be applied. It is understood that the invention is not limited to the embodiments described. The device according to the invention can in particular be used for different types of vehicle having sliding or swinging/sliding doors, or for other movable doors.

What is claimed is:

1. A motorised device for locking a door intended in particular for a rail vehicle, with at least one leaf, the latter being able to close off and leave clear an opening respectively in the closed and open position, and to slide in a longitudinal direction between these positions along a wall of the vehicle where the opening is provided, said device comprising:

a tilting-body motor, intended to be mounted on the vehicle, the axis of said motor being substantially parallel to the longitudinal direction of movement of said leaf, an output of said motor being connected to means for the longitudinal transmission of movement to said leaf, said body of said motor being arranged to be driven in conjoint rotation by the output or immobilised in rotation with respect to the latter, and means of locking said leaf in the closed position comprising at least one locking finger and a substantially longitudinal ramp, said finger and said ramp being fixed respectively to said tilting body and to said leaf, said body of said motor has at its end directed towards said leaf in the closed position a fixed arm extending in a direction substantially parallel to the axis of said motor on the side of said leaf in the closed position, said locking finger being fixed to the free end of said arm so that said locking finger is fixed at a distance from the end of said motor body.

2. A device according to claim 1, wherein said locking means also comprise a second locking finger fixed to the end of said body of said motor directed towards said leaf in the closed position and extending radially.

3. A device according to claim 2, wherein each of said locking fingers is capable of receiving a running roller mounted so as to pivot with respect to a longitudinal direction.

4. A device according to claim 2, wherein said ramp is provided with at least one end surface substantially perpendicular to the axis of said motor and a longitudinal track joining said end surface, so that in the closed position, said locking finger situated at the end of said arm of said motor is in abutment longitudinally against said end surface, and in the open position, said finger fixed to the end of said body of said motor is positioned on said track.

5. A device according to claim 1 wherein said ramp is provided with at least one end surface substantially perpendicular to the axis of said motor and a longitudinal track joining said end surface, so that in the closed position, said locking finger situated at the end of said arm of said motor is in abutment longitudinally against said end surface and in the open position, said finger (18) is positioned on said track.

6. A device according to claim 5, wherein the tilting of said motor is determined so as to ensure the disengagement from an end surface against which said finger is brought in abutment towards said longitudinal track of said ramp, or the contact on said longitudinal track of said locking finger fixed to the end of said body of said motor.

7. A rail vehicle device comprising:

a leaf having a longitudinal direction of movement;

a tilting-body motor having an axis substantially parallel to the longitudinal direction, said motor having a body, and said motor being operable to longitudinally move said leaf;

a lock operably locking said leaf in a closed position, said lock including at least a first locking finger and a substantially longitudinal ramp, said finger and said ramp being fixed with respect to said body of said motor and to said leaf; and a fixed member located at an end of said motor body toward said leaf and extending in a direction substantially parallel to said axis of said motor when in said closed position;

said locking finger being fixed to a free end of said fixed member so that said locking finger is fixed at a desired distance from said end of said motor body.

8. A device according to claim 7, further comprising a second locking finger fixed to said end of said motor body, said second finger extending radially when in said closed position.

9. A device according to claim 8, wherein each of said locking fingers is capable of receiving a roller operable to pivot with respect to said longitudinal direction.

10. A device according to claim 7, further comprising:

a track;

said ramp having at least one end surface located substantially perpendicular to said axis of said motor;

wherein when in said closed position, said locking finger abuts against said end surface of said ramp; and wherein when in an open position, said locking finger is positioned substantially on said track.

11. A device according to claim 7, wherein tilting of said motor disengages said finger from an end surface of said ramp.

* * * * *